US009593853B2

(12) United States Patent
Montgomery et al.

(10) Patent No.: US 9,593,853 B2
(45) Date of Patent: Mar. 14, 2017

(54) GAS FLOW PATH FOR A GAS TURBINE ENGINE

(71) Applicant: Siemens Energy, Inc., Orlando, FL (US)

(72) Inventors: Matthew D. Montgomery, Jupiter, FL (US); Richard C. Charron, West Palm Beach, FL (US); Gary D. Snyder, Jupiter, FL (US); William W. Pankey, Palm Beach Gardens, FL (US); Clinton A. Mayer, Jupiter, FL (US); Benjamin G. Hettinger, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 432 days.

(21) Appl. No.: 14/185,352

(22) Filed: Feb. 20, 2014

(65) Prior Publication Data

US 2015/0233582 A1 Aug. 20, 2015

(51) Int. Cl.
*F23R 3/46* (2006.01)

(52) U.S. Cl.
CPC ..... *F23R 3/46* (2013.01)

(58) Field of Classification Search
CPC . F01D 9/023; F23R 3/425; F23R 3/46; Y02T 50/675; F02C 3/14
USPC ..... 60/752, 799, 39.37, 269, 804, 805, 722, 60/226.1, 263, 264, 753–760, 809
See application file for complete search history.

(56) References Cited

U.S. PATENT DOCUMENTS

| | | | | |
|---|---|---|---|---|
| 3,333,762 | A * | 8/1967 | Vrana | F04D 21/00 415/207 |
| 5,983,641 | A | 11/1999 | Mandai et al. | |
| 7,299,617 | B2 * | 11/2007 | Oltmanns | F01D 9/023 60/39.37 |
| 7,721,547 | B2 | 5/2010 | Bancalari et al. | |
| 8,065,881 | B2 | 11/2011 | Charron et al. | |
| 8,113,003 | B2 | 2/2012 | Charron et al. | |
| 8,230,688 | B2 | 7/2012 | Wilson et al. | |
| 8,276,389 | B2 | 10/2012 | Charron et al. | |
| 9,309,774 | B2 * | 4/2016 | Charron | F01D 9/047 |
| 2003/0167776 | A1 * | 9/2003 | Coppola | F01D 9/023 60/800 |

(Continued)

FOREIGN PATENT DOCUMENTS

| | | | |
|---|---|---|---|
| CN | 101784842 | A | 7/2010 |
| CN | 103375262 | A | 10/2013 |
| FR | 2979670 | A1 | 3/2013 |

OTHER PUBLICATIONS

PCT international Search Report mailed May 4, 2015 corresponding to PCT International Application No. PCT/US2015/013402 filed Jan. 29, 2015 (11 pages).

*Primary Examiner* — Peter Helvey

(57) ABSTRACT

A duct arrangement in a can annular gas turbine engine. The gas turbine engine has a gas delivery structure for delivering gases from a plurality of combustors to an annular chamber that extends circumferentially and is oriented concentric to a gas turbine engine longitudinal axis for delivering the gas flow to a first row of blades A gas flow path is formed by the duct arrangement between a respective combustor and the annular chamber for conveying gases from each combustor to the first row of turbine blades The duct arrangement includes at least one straight section having a centerline that is misaligned with a centerline of the combustor.

13 Claims, 5 Drawing Sheets

(56) References Cited

U.S. PATENT DOCUMENTS

| | | | | |
|---|---|---|---|---|
| 2006/0127827 | A1* | 6/2006 | Yoshida | F23C 7/004 431/8 |
| 2007/0017225 | A1* | 1/2007 | Bancalari | F01D 9/023 60/752 |
| 2008/0087020 | A1* | 4/2008 | Hsu | F01D 9/023 60/752 |
| 2010/0077719 | A1 | 4/2010 | Wilson et al. | |
| 2010/0115953 | A1 | 5/2010 | Davis, Jr. et al. | |
| 2010/0180605 | A1 | 7/2010 | Charron | |
| 2011/0203282 | A1 | 8/2011 | Charron et al. | |
| 2011/0259015 | A1 | 10/2011 | Johns et al. | |
| 2013/0081399 | A1 | 4/2013 | Wiebe et al. | |
| 2013/0239585 | A1 | 9/2013 | Morrison | |

* cited by examiner

GAS FLOW PATH FOR A GAS TURBINE ENGINE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates in general to turbine engines and, more particularly, to a gas flow path for conveying a hot working gas from a combustor to turbine blades in a gas turbine engine

BACKGROUND OF THE INVENTION

A gas turbine engine typically includes a compressor section, a combustion section including a plurality of combustors, and a turbine section Ambient air is compressed in the compressor section and conveyed to the combustors in the combustion section The combustors combine the compressed air with a fuel and ignite the mixture creating combustion products defining hot working gases that flow in a turbulent manner and at a high velocity. The working gases are routed to the turbine section via a plurality of gas passages, conventionally referred to as transition ducts. Within the turbine section are rows of stationary vane assemblies and rotating blade assemblies. The rotating blade assemblies are coupled to a turbine rotor As the working gases expand through the turbine section, the working gases cause the blade assemblies, and therefore the turbine rotor, to rotate The turbine rotor may be linked to an electric generator, wherein the rotation of the turbine rotor can be used to produce electricity in the generator.

The gas passages each include an inlet positioned adjacent to a respective combustor, and each gas path routes a flow of working gases into the turbine section through a turbine inlet structure associated with a first row of turbine vanes.

SUMMARY OF THE INVENTION

In accordance with an aspect of the invention, a duct arrangement is provided in a can annular gas turbine engine. The gas turbine engine has a gas delivery structure for delivering gases from a plurality of combustors to an annular chamber that extends circumferentially and is oriented concentric to a gas turbine engine longitudinal axis for delivering the gas flow to a first row of blades. A gas flow path is formed by the duct arrangement between a respective combustor and the annular chamber for conveying gases from each combustor to the first row of turbine blades. The duct arrangement comprises at least one straight section having a centerline that is misaligned with a centerline of the combustor The duct arrangement may include an integrated exit piece (IEP) having an inlet section associated with the annular chamber, and a cone section having an inlet end receiving the gas flow and an outlet end connected to an inlet end of the inlet section, and wherein the at least one straight section may be formed by the inlet section A centerline of the cone section may be collinear with the centerline of the combustor A centerline of the cone section may be angled relative to a centerline of the inlet section of the IEP.

A centerline of the cone section may be offset relative to a centerline of the inlet section of the IEP.

The duct arrangement may include an integrated exit piece (IEP) having an inlet section associated with the annular chamber and a cone section having an inlet end receiving the gas flow and an outlet end connected to an inlet end of the inlet section, and wherein the at least one straight section may be formed by the cone section The inlet section of the IEP may have a centerline that is misaligned with both the centerline of the combustor and a centerline of the cone section.

The duct arrangement may include an integrated exit piece (IEP) having an inlet section associated with the annular chamber, and a cone section having an inlet end receiving the gas flow and an outlet end connected to an inlet end of the inlet section, and wherein an end of the at least one straight section may include a joint formed by a band clamp permitting a misalignment between centerlines along the duct arrangement.

The end of the at least one straight section may include a flange cooperating with a flange on an adjacent element of the duct arrangement, and adjoining surfaces of the flanges may be formed by spherical surfaces engaged against each other A radially inward facing side of the band clamp may be formed as a V-shaped cavity facing the flanges, and a surface of the band clamp may be formed as a spherical surface for engaging a spherical surface of one of the flanges, and another surface of the band clamp may be formed as a conical surface for engaging a matching conical surface on the other of the flanges.

The band clamp may include two clamp halves fastened together at diametrically opposed sides of the clamp The joint may be formed at a connection between the cone section and the inlet end of the inlet section.

In accordance with another aspect of the invention, a duct arrangement is provided in a can annular gas turbine engine The gas turbine engine has a gas delivery structure for delivering gases from a plurality of combustors to an annular chamber that extends circumferentially and is oriented concentric to a gas turbine engine longitudinal axis for delivering the gas flow to a first row of blades A gas flow path is formed by the duct arrangement between a respective combustor and the annular chamber for conveying gases from each combustor to the first row of turbine blades The duct arrangement comprises an integrated exit piece (IEP) having an inlet section associated with the annular chamber, and a cone section having an inlet end receiving the gas flow and an outlet end connected to an inlet end of the inlet section. The inlet section of the IEP defines a straight section having a centerline that is misaligned with both a centerline of the combustor and a centerline of the cone section.

A centerline of the cone section may be collinear with the centerline of the combustor.

A centerline of the cone section may be offset relative to a centerline of the inlet section of the IEP.

A centerline of the cone section may be angled relative to a centerline of the inlet section of the IEP.

The outlet end of the cone section may include a flange located adjacent to a flange on the inlet end of the inlet section of the IEP, and may include a joint formed by a spherical band clamp extending over the flanges to permit a misalignment between the centerlines of the cone section and the inlet section of the IEP Adjoining surfaces of the flanges may be formed by spherical surfaces engaged against each other. A radially inward facing side of the band clamp may be formed as a V-shaped cavity facing the flanges, and a surface of the band clamp may be formed as a spherical surface for engaging a spherical surface of one of the flanges and another surface of the band clamp may be formed as a conical surface for engaging a matching conical surface on the other of the flanges.

In accordance with a particular beneficial aspect of the invention, the duct arrangement described herein can provide a change of flow angle into the turbine, such as may be necessitated when the turbine engine is upgraded for more flow capacity, without requiring a change to the turbine engine casing and related structures which support the combustor.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
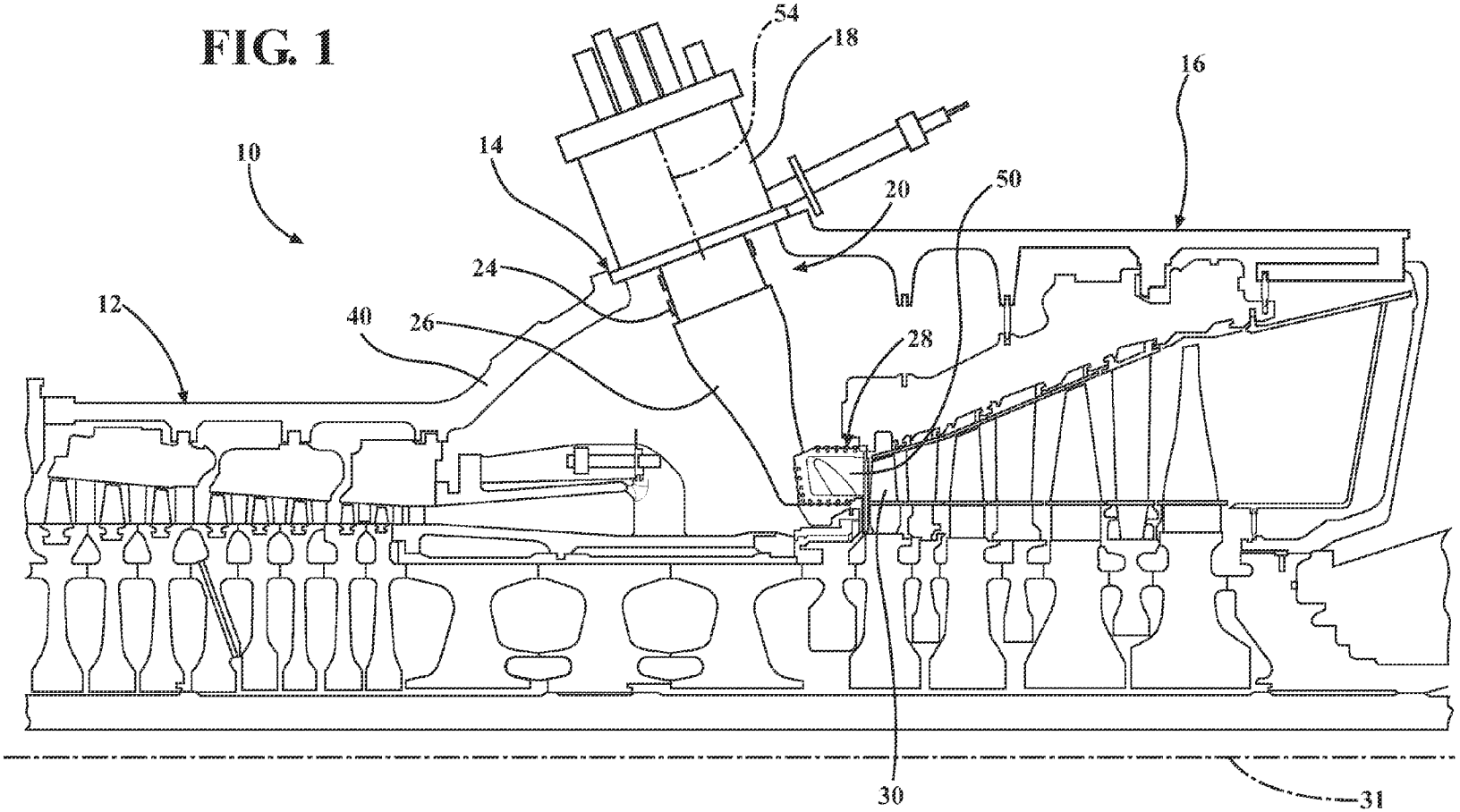
FIG. 1 is a cross-sectional view through a portion of a turbine engine illustrating aspects of the present invention.

One assembly of a system for delivery of hot working gases from combustors to a turbine section of a gas turbine engine, in accordance with an aspect of the invention, orients combustor cans of a gas turbine engine in a tangential arrangement In particular, combustor cans of a can-annular combustor are each oriented to direct a hot working gas flow through an assembly of components defining gas passages that direct the individual gas flows in a radially inward and circumferentially angled direction into an annular chamber immediately upstream and adjacent a first row of turbine blades in a turbine section of the engine. For example, the arrangement of gas passages providing a flow to an annular chamber may generally correspond to a structure for supplying a flow of gases directly to a first row of turbine blades, without a need for row one turbine vanes, as is described in U.S. Pat. No. 8,230,688 to Wilson et al., which patent is incorporated herein by reference As described in the Wilson et al. patent, the gas passage can typically define a straight flow path extending from the combustor to the annular chamber Referring to FIG. 1, a gas turbine engine 10 is shown including a compressor section 12, a combustion section 14 and a turbine section 16 The compressor section 12 compresses ambient air and supplies the compressed air to a plurality of cylindrical combustors 18 in the combustion section 14. In the illustrated embodiment, the combustors 18 comprise can-annular combustors. The combustors 18 combine the compressed air with fuel and ignite the mixture to create combustion products forming a hot working gas flow from each of the combustors 18 The gas flow is conveyed through a duct arrangement comprising individual gas paths 20 associated with each of the combustors 18 to an annular chamber for delivering the gas flows from the combustors 18 to the turbine section 16. The gas paths 20 can include a cylinder section 24 connected to and receiving the gas flow from a respective combustor 18, and a cone section 26 receiving the gas flow from the cylinder section 24 and conveying the gas flow to an integrated exit piece 28 (hereinafter referred to as an "IEP") A plurality of IEPs 28 are provided, one for each combustor 18, and the plurality of IEPs 28 are connected to form an annular structure forward of the turbine section 16. It may be noted that the turbine section 16 does not include a first row of vanes, and the annular structure delivers the gas flow in an aft direction directly to a first row of turbine blades 30 in the turbine section 16.

As used herein, "forward" refers to an engine inlet side, and "aft" or "rearward" refers to an engine exhaust side with respect to a longitudinal axis 31 of the gas turbine engine 10. "Inner" and "outer" refer to radial positions with respect to the gas turbine engine longitudinal axis 31. "Upstream" and "downstream" are used with reference to the gas flow direction through the cylinder section 24, cone section 26 and IEP 28.

Figure 2:
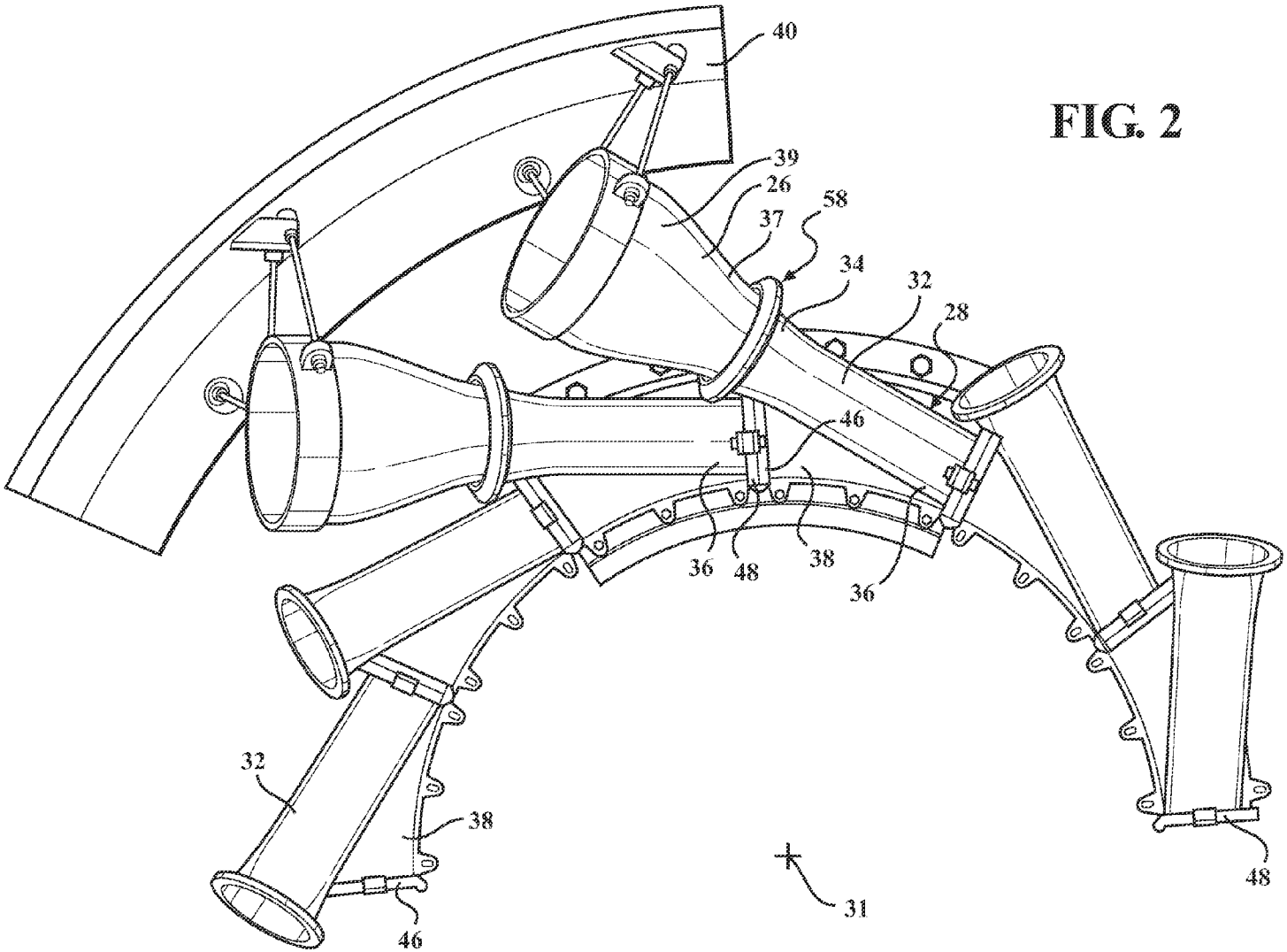
FIG. 2 is a perspective view of a duct arrangement in accordance with aspects of the invention.

As may be seen in FIG. 2, each IEP 28 can include an inlet section 32 having a generally rectangular cross-section, and having an upstream inlet end 34 and a downstream end 36 wherein the upstream inlet end 34 is joined to a downstream outlet end 37 of the cone section 26 A connection segment 38 is formed integrally with the inlet section 32 and is located at a radially inner side of the IEP 28. The connection segment 38 has a generally rectangular cross-section and is configured to form a junction with an upstream adjacent IEP 28. In particular, the connection segment 38 includes a connection flange 46 that is adapted to be connected to a corresponding flange 48 on the downstream end 36 of the inlet section 32 of an upstream adjacent IEP 28. It may be understood that the connected IEPs 28 form an annular chamber 50 (FIG. 1) that is open in the aft direction, extending circumferentially and oriented concentric to the longitudinal axis 31 of the engine for delivering the gas flow to the first row of blades 30. A description of a known IEP of the type that may be used in combination with the present invention is described in the previously noted U.S. Pat. No. 8,230,688.

As noted above, the known arrangement for conveying the gas flow from each combustor to the first row of turbine blades 30 comprises a straight flow path, i.e. a straight continuous axis from the combustor to the annular chamber. In the event of a design change to an existing turbine engine, such as to implement an increase in engine flow, it may be necessary to provide a change of the flow angle entering the turbine section 16. In accordance with an aspect of the invention, the IEPs 28, as illustrated herein, may be reconfigured such that a flow angle defined through the inlet section 32 can be reoriented to an alternative position, such as to provide a reoriented angle for the direction of gas flow passing from the annular chamber 50 to the first row of blades 30. This could be accomplished by substituting the original IEPs with reconfigured replacement IEPs 28

In the event that the IEPs 28 are reconfigured, with an associated reorientation of flow angle through the inlet section 32 to the annular chamber 50, the combustors 18 will remain at their previous design orientation since repositioning of the combustors 18 would require a modification to the mid-frame casing 40 for the engine 10, which modification would not be easily accomplished in current engine designs Hence, to implement the currently proposed reorientation of the flow angle through the IEPs 28, flow path configurations in accordance with an aspect of the invention are proposed that redirect straight line segments of the flow path extending from the combustors 18 to the annular chamber 50. That is, each of the cylindrical section 24, the cone section 26 and the inlet section 32 can define a straight line segment for the flow path 20, which may be oriented relative to each other to provide a desired flow path direction Referring to FIG. 3, an IEP 28 is illustrated having an inlet section 32 defining a straight path portion providing a reoriented flow angle along an inlet section line 42 that is parallel to an inlet section centerline 49 (FIG. 4A) defined by the inlet section 32. For example, an angle α depicted in FIG. 3 describes an angle formed between the inlet section line 42 and a cone section line 44 that is parallel to a cone centerline 52 (FIGS. 4A and 6) defined by the cone section 26. It may be noted that the cone section line 44 could be parallel to a combustor centerline 54 (FIG. 1) defined by the combustor 18, and can additionally be parallel to a cylinder centerline 56 (FIG. 6) defined by the cylinder section 24. Further, the cone centerline 52 can be collinear with the respective combustor and cylinder centerlines 54, 56, although it is not necessary that these sections be collinear In an alternative configuration, the cone centerline 52 may be angled relative to the combustor centerline 54, and an additional angle (or misalignment) may be defined between the cone centerline 59 and the inlet section centerline 49

Figure 3:
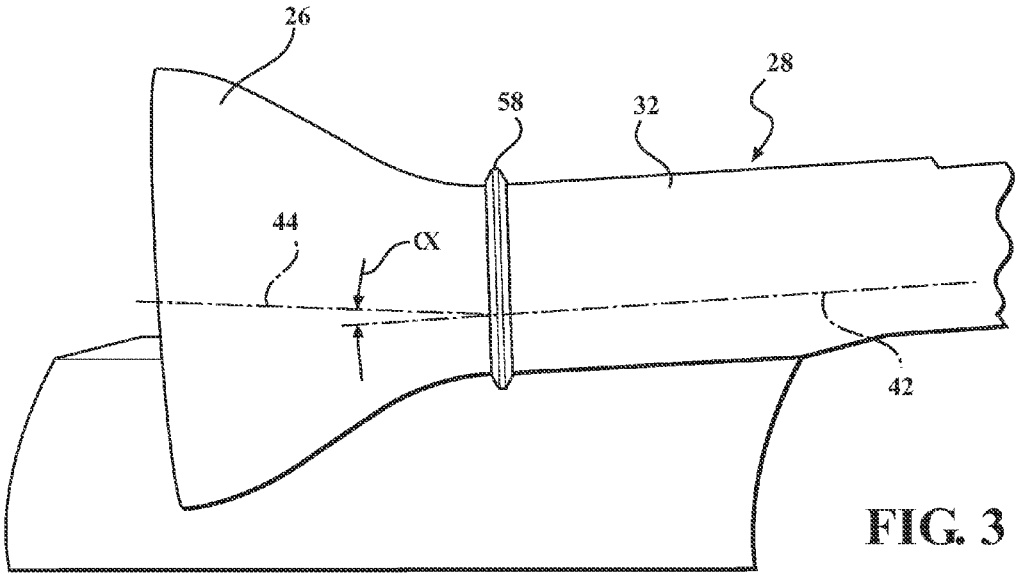
FIG. 3 is a plan view radially inward of a duct arrangement in accordance with aspects of the invention.
Figure 4:
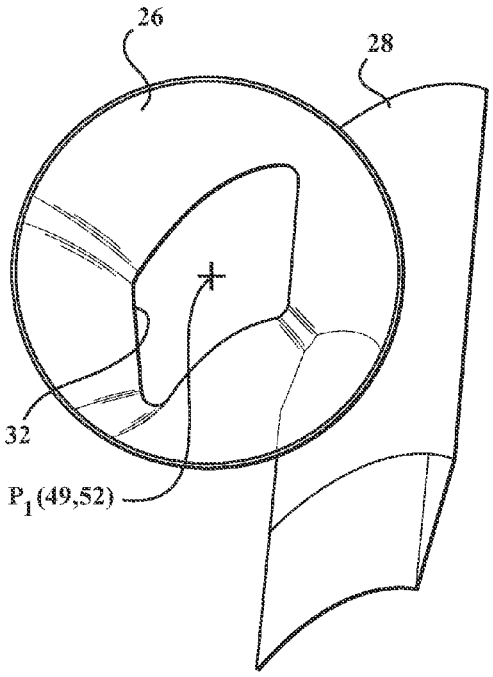
FIG. 4 is a downstream end view through a cone section of the duct arrangement illustrating a configuration in which centerlines of the cone section and the IEP coincide at an exit plane formed between the cone section and the IEP.

In a further alternative configuration, accommodating the redirection or displacement of the inlet section centerline 49 relative to the combustor centerline 54 may include an offset of the centerline 52 of the cone section 26 relative to the centerline 49 of the inlet section 32. Referring to FIG. 4, a non-offset configuration is illustrated where it can be seen that the inlet section 32 of the IEP 28 and the cone section 26 are joined such that their respective centerlines 49, 52 coincide at a common point $P_1$, i.e., at a point located on a plane passing through a junction 58 (FIG. 3) between the inlet section 32 and the cone section 26 Although not apparent in FIG. 4, the centerlines 49, 52 may extend at an angle α relative to each other, as depicted in FIG. 3.

Figure 4A:
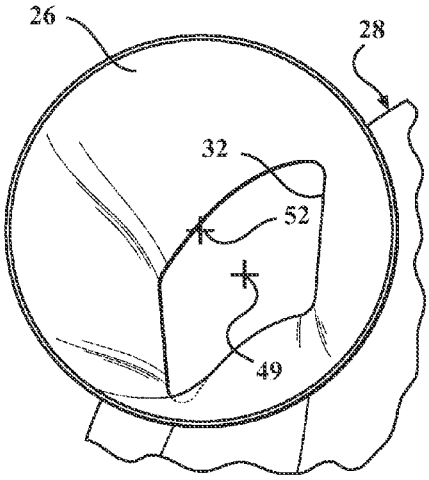
FIG. 4A is a downstream end view through a cone section of the duct arrangement illustrating a configuration in which centerlines of the cone section and the IEP are offset at an exit plane formed between the cone section and the IEP.
Figure 5:
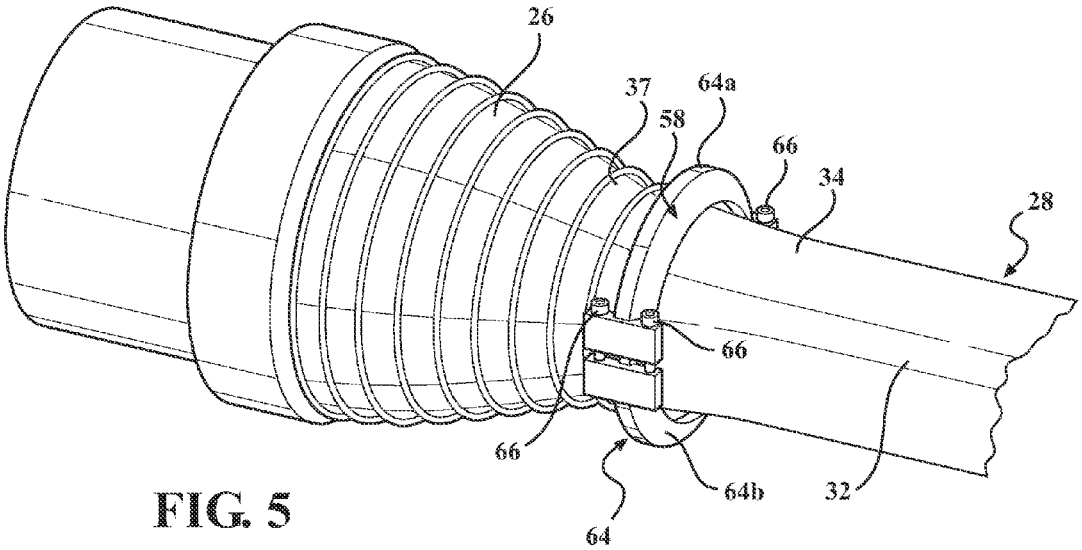
FIG. 5 is a perspective view illustrating a junction between a cone section and an IEP in accordance with aspects of the invention.

Referring further to FIG. 4A, an offset configuration is illustrated where the position of the cone section 26 relative to the inlet section 32 can be displaced such that, at the plane of the junction 58, the cone centerline 52 is offset relative to the inlet section centerline 49 That is, the cone centerline 52 is laterally displaced relative to the inlet section centerline 49 at the plane of the junction 58. In addition, the centerline 52 of the offset cone 26 illustrated in FIG. 4A can be oriented at an angle relative to the inlet section centerline 49, such as at an angle α as illustrated in FIG. 3. It should be noted that the configurations depicted in FIGS. 3, 4 and 4A may require that at least a portion the cone section 26 be formed with a shape that is somewhat distorted from an axisymmetric cone in order to accommodate the misalignment of axes formed by the angled and/or offset cone section 26

Figure 6:
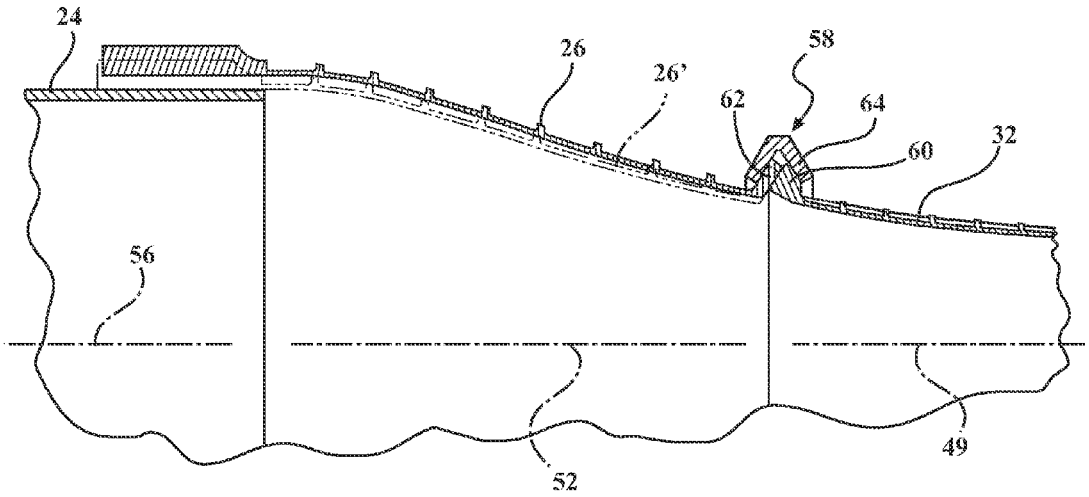
FIG. 6 is a cross sectional view through the duct arrangement illustrating the junction between the cone section and the IEP and showing a displacement of the cone section relative to the IEP.
Figure 7:
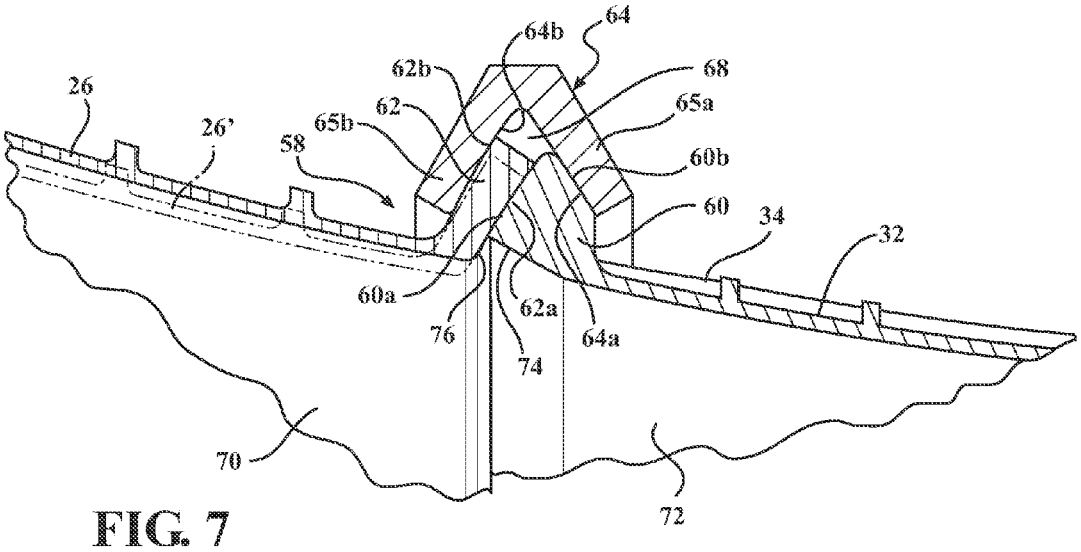
FIG. 7 is an enlarged view of the junction illustrated in FIG. 6.

Referring to FIGS. 5-8, a structure for accommodating a misalignment between the inlet section 32 and the upstream sections of the duct arrangement defined by the gas path 20 is illustrated As noted above, a junction 58 can be defined between the outlet end 37 of the cone section 26 and the inlet end 34 of the inlet section 32 of the IEP 28. As seen in FIGS. 6 and 7, the junction 58 includes an outwardly extending inlet flange 60 formed at the inlet end 34 of the inlet section 32, and an adjacent outwardly extending cone flange 62 formed at the outlet end 37 of the cone section 26. The inlet flange 60 includes an engagement surface 60*a* located in engagement with an engagement surface 62*a* of the cone flange 62 The engagement surfaces 60*a*, 62 are both oriented at an angle extending in a downstream and outward direction relative to the inlet and cone section centerlines, 49, 52

The junction 58 further includes a band clamp 64 surrounding the flanges 60, 62. The band clamp 64 preferably comprises a spherical band clamp formed as a split clamp, including clamp halves 64A, 64B, and preferably includes pairs of clamp bolts 66 (FIG. 5) on each side of the clamp 64 to facilitate assembly of the clamp 64. For example, the pairs of clamp bolts 66 can be located in threaded engagement with ends of the clamp halves 64A, 64B on diametrically opposite sides of the junction 58, with bolt heads facing toward the casing 40, and the casing 40 can be provided with circumferentially spaced access openings or ports (not shown) through which the clamp 64 can be accessed, including access for tightening the bolts 66.

As seen in FIG. 7, the clamp 64 is formed as a rigid V-shaped structure comprising a circular V-band clamp having a first leg 65*a* defining a first clamp surface 64*a*, and a second leg 65*b* defining a second clamp surface 64*b* oriented at an acute angle relative to the first clamp surface 64*a* to form a V-shaped cavity 68 facing the flanges 60, 62. The inlet flange 60 is formed with a first flange surface 60*b* oriented for engagement with the first clamp surface 64*a*. Specifically, the first flange surface 60*b* is an annular surface that is oriented at an angle extending in an upstream and outward direction relative to the inlet section centerline 49 The cone flange 62 is formed with a second flange surface 62*b* oriented for engagement with the second clamp surface 64*b* Specifically, the second flange surface 62*b* is an annular surface that is oriented at an angle extending in a downstream and outward direction relative to the cone section centerline 52. It may be understood that during an assembly operation, tightening of the clamp bolts 66 causes the clamp surfaces 64*a*, 64*b* to move inwardly along the flange surfaces 60*b*, 62*b* with a resulting biasing of the flanges 60, 62 into engagement with each other In accordance with an aspect of the invention, the flanges 60, 62 and the clamp 64 are additionally configured to permit adjustment of the cone section 26 relative to the inlet section 32, such as is described above with reference to FIGS. 3, 4 and 4A. In particular, the cooperating engagement surfaces 60*a*, 62*a* are each configured as spherical surfaces, such that the junction 58 is formed as a swivel joint permitting a misalignment of the conical section 26 relative to the inlet section 32 That is, the engagement surfaces 60*a*, 62*a* define a radius of curvature, such as a radius that may be defined from the inlet section centerline 49 or conical centerline 52 to the flanges 60, 62, in order to permit swiveling or sliding movement of the conical section 26 relative to the inlet section 32 at the junction 58. The spherical shape of the engagement surfaces 60*a*, 62*a* ensure that substantially continuous engagement is maintained across the engagement surfaces 60*a*, 62*a*, with associated sealing, at a range of displaced positions of the conical section 26 A displacement of the conical section 26 is illustrated in FIGS. 6 and 7, where reference number 26 identifies a position of the conical section 26 in alignment with the inlet section 32, i.e., with the conical centerline 52 collinear with the inlet section centerline 49, and the reference numeral 26' identifies a position of the conical section 26 in a swiveled position relative to the inlet section, i.e., with the conical centerline 52 misaligned from the inlet section centerline 49. The described configuration for the junction 58 can provide an angular adjustment of at least one degree, which can correspond to approximately 11 15 mm of displacement at an inlet end 39 of the cone section 26 However, it should be understood that the invention is not limited to this particular amount of movement.

Further, the outwardly facing second flange surface 62*b* and cooperating second clamp surface 64*b* are configured as spherical surfaces with a curvature corresponding to the curvature of the engagement surfaces 60*a*, 62*a* to permit the conical flange 62 to swivel within the clamp cavity 68 without interference. The first flange surface 60*b* and cooperating first clamp surface 64*a* can be formed as conical surfaces, and provide a ramp configuration facilitating biasing of the flanges 60, 62 into engagement with each other as the clamp halves 60A, 60B are drawn together by the clamp bolts 66

Figure 8:
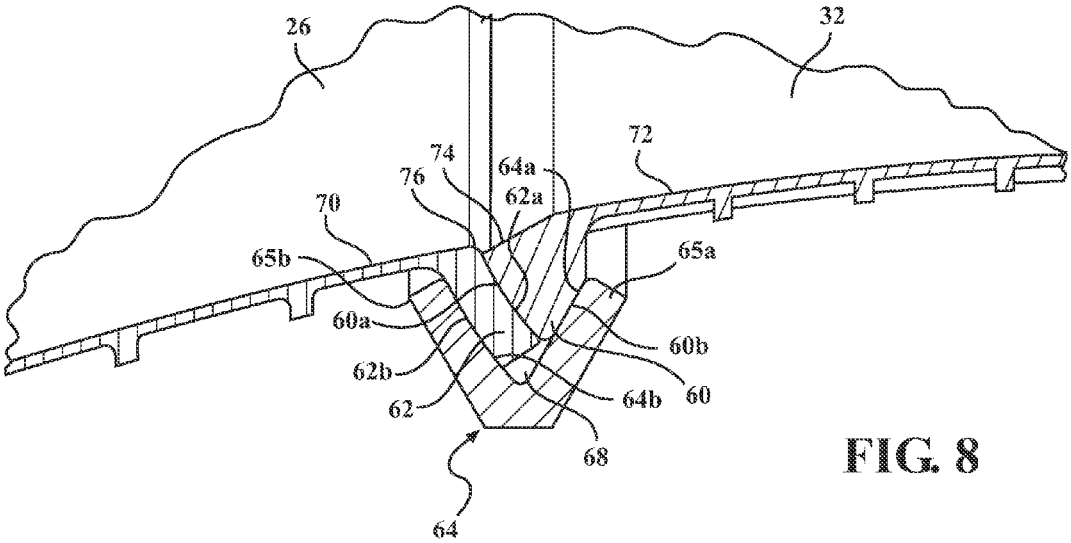
FIG. 8 is a cross sectional view through the duct arrangement showing an alternative displacement of the cone section relative to the IEP

It should be noted that the swiveled position of the conical section 26, depicted by 26' in FIG. 7, positions at least a portion of an inner conical wall 70 of the conical section 26 inwardly toward the insert section centerline 49. This repositioning of the inner conical wall 70 permits passage of gases from the conical section 26 to the inlet section 32 without interference from an adjacent portion of an inner inlet section wall 72. However, as illustrated in FIG. 8, the swiveled position of the conical section 26 can result in at least a portion of the inner conical wall 70 being positioned outwardly relative to the inlet section wall 72. In order to ensure that the inner inlet section wall 72 adjacent to the inner conical wall 70 does not form a dam-type obstruction to flow passing downstream from the conical section 26, a leading edge surface 74 of the inner inlet section wall 72 can be formed as a chamfered or ramped surface. In particular, the leading edge surface 74 may be formed as a conical surface extending outward in an upstream direction Hence, the leading edge surface 74 can provide a smooth transition for gases passing into the inlet section 32 of the IEP 28 from a downstream edge 76 of the conical section 26

It should be understood that, although the misalignment of the inlet section 32 relative to the combustor 18 is specifically described with reference to displacement of the cone centerline 52 relative to the inlet section centerline 49, the described displacement could alternatively, or in addition, be provided at other junction locations between segments of the flow path 20. For example, a displacement may be provided between the cylinder section 24 and the cone section 26. Further, the junction 58 described with reference to the flanges 60, 62 and the spherical clamp 64 could be provided at other or additional locations, such as at the junction between the cylinder section 24 and the cone section 26.

From the above, it may be understood the present invention can facilitate repositioning and realignment of the flow paths 20, permitting repositioning of the IEPs 28, without requiring repositioning of the combustors 18

As described above, aspects of the invention facilitate realignment of the flow of gases passing from the inlet sections 32 to the annular chamber 50, such as may be desirable for implementing a change in operating parameters for the engine 10. In accordance with additional aspects of the invention, a change in alignment between the inlet section centerline 49 and the combustor centerline 54 can be accommodated by an adjustable joint, such as is described for the junction 58 providing the spherical surfaces of the flanges 60, 62 and the clamp 64. Further, the adjustable joint provided for the junction 58 can also compensate for any variation in the alignment of the sections of the flow path 20 during installation of the flow path 20 in the engine 10. Additionally, the described clamp structure can facilitate assembly of the junction 58 in a limited access area of the engine 10 where bolted flanges may be difficult to assemble.

While particular embodiments of the present invention have been illustrated and described, it would be obvious to those skilled in the art that various other changes and modifications can be made without departing from the spirit and scope of the invention It is therefore intended to cover in the appended claims all such changes and modifications that are within the scope of this invention.

What is claimed is:

1. In a can annular gas turbine engine having a gas delivery structure for delivering gases from a plurality of combustors to an annular chamber that extends circumferentially and is oriented concentric to a gas turbine engine longitudinal axis for delivering the gas flow to a first row of blades, a gas flow path formed by a duct arrangement between a respective combustor and the annular chamber for conveying gases from each combustor to the first row of turbine blades, the duct arrangement comprising:

at least one straight section having a centerline that is misaligned with a centerline of the combustor; and an integrated exit piece (IEP) having an inlet section associated with the annular chamber, and a cone section having an inlet end receiving the gas flow and an outlet end connected to an inlet end of the inlet section, and wherein an end of the at least one straight section includes a joint formed by a band clamp permitting a misalignment between centerlines along the duct arrangement, wherein the end of the at least one straight section includes a flange cooperating with a flange on an adjacent element of the duct arrangement, and adjoining surfaces of the flanges are formed by spherical surfaces engaged against each other.

2. The duct arrangement of claim 1, wherein a radially inward facing side of the band clamp is formed as a V-shaped cavity facing the flanges, and a surface of the band clamp is formed as a spherical surface for engaging a spherical surface of one of the flanges, and another surface of the band clamp is formed as a conical surface for engaging a matching conical surface on the other of the flanges.

3. The duct arrangement of claim 1, wherein the band clamp includes two clamp halves fastened together at diametrically opposed sides of the clamp.

4. The duct arrangement of claim 1, wherein the joint is formed at a connection between the cone section and the inlet end of the inlet section.

5. The duct arrangement of claim 1, wherein the at least one straight section is formed by the inlet section of the IEP.

6. The duct arrangement of claim 5, wherein a centerline of the cone section is collinear with the centerline of the combustor.

7. The duct arrangement of claim 5, wherein a centerline of the cone section is angled relative to a centerline of the inlet section of the IEP.

8. The duct arrangement of claim 5, wherein a centerline of the cone section is offset relative to a centerline of the inlet section of the IEP.

9. The duct arrangement of claim 1, wherein the at least one straight section is formed by the cone section.

10. The duct arrangement of claim 9, wherein the inlet section of the IEP has a centerline that is misaligned with both the centerline of the combustor and a centerline of the cone section.

11. In a can annular gas turbine engine having a gas delivery structure for delivering gases from a plurality of combustors to an annular chamber that extends circumferentially and is oriented concentric to a gas turbine engine longitudinal axis for delivering the gas flow to a first row of blades, a gas flow path formed by a duct arrangement between a respective combustor and the annular chamber for conveying gases from each combustor to the first row of turbine blades, the duct arrangement comprising:

an integrated exit piece (IEP) having an inlet section associated with the annular chamber, and a cone section having an inlet end receiving the gas flow and an outlet end connected to an inlet end of the inlet section, wherein the inlet section of the IEP defines a straight section having a centerline that is misaligned with both a centerline of the combustor and a centerline of the cone section, wherein a centerline of the cone section is angled relative to a centerline of the inlet section of the IEP, wherein the outlet end of the cone section includes a flange located adjacent to a flange on the inlet end of the inlet section of the IEP, and including a joint formed by a spherical band clamp extending over the flanges to permit a misalignment between the centerlines of the cone section and the inlet section of the IEP, wherein adjoining surfaces of the flanges are formed by spherical surfaces engaged against each other.

12. The duct arrangement of claim 11, wherein a centerline of the cone section is offset relative to a centerline of the inlet section of the IEP.

13. The duct arrangement of claim 11, wherein a radially inward facing side of the band clamp is formed as a V-shaped cavity facing the flanges, and a surface of the band clamp is formed as a spherical surface for engaging a spherical surface of one of the flanges and another surface of the band clamp is formed as a conical surface for engaging a matching conical surface on the other of the flanges.

* * * * *